US011702903B2

(12) United States Patent
Sequera et al.

(10) Patent No.: US 11,702,903 B2
(45) Date of Patent: Jul. 18, 2023

(54) ACTUATOR, METHOD AND SYSTEM

(71) Applicants: Daniel Sequera, Houston, TX (US); John Vu, Houston, TX (US); Daniel Ewing, Katy, TX (US)

(72) Inventors: Daniel Sequera, Houston, TX (US); John Vu, Houston, TX (US); Daniel Ewing, Katy, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 9 days.

(21) Appl. No.: 17/223,172

(22) Filed: Apr. 6, 2021

(65) Prior Publication Data

US 2022/0316298 A1 Oct. 6, 2022

(51) Int. Cl.

| | |
|---|---|
| ***E21B 36/04*** | (2006.01) |
| ***E21B 23/00*** | (2006.01) |
| ***E21B 34/06*** | (2006.01) |

(52) U.S. Cl.

CPC ..... *E21B 34/063* (2013.01); *E21B 23/00* (2013.01); *E21B 36/04* (2013.01)

(58) Field of Classification Search

CPC ..... E21B 36/04; E21B 23/00

See application file for complete search history.

(56) References Cited

U.S. PATENT DOCUMENTS

| | | | | |
|---|---|---|---|---|
| 5,052,489 | A * | 10/1991 | Carisella | F42D 1/04 337/145 |
| 5,115,865 | A * | 5/1992 | Carisella | E21B 43/1185 337/145 |
| 2005/0092495 | A1 | 5/2005 | Evans | |
| 2005/0150693 | A1 | 7/2005 | Madden | |
| 2017/0239727 | A1 | 8/2017 | Oxford | |
| 2020/0240241 | A1 | 7/2020 | Oprea et al. | |

FOREIGN PATENT DOCUMENTS

| | | |
|---|---|---|
| EP | 2835493 A1 | 2/2015 |

OTHER PUBLICATIONS

Notification of Transmittal of the International Search Report and the Written Opinion of the International Searching Authority, or the Declaration; PCT/US2022/071507; dated Jul. 25, 2022; 8 pages.

* cited by examiner

*Primary Examiner* — Catherine Loikith
(74) *Attorney, Agent, or Firm* — Cantor Colburn LLP

(57) ABSTRACT

An actuator for another tool includes a housing that is either modular and attachable to the tool or may be incorporated into the another tool. Within the housing is a biasing member that may be retained in a compressed condition by a retainer. A trigger holding the retainer, the trigger having a trigger head anchorable to the housing, a separation neck having a helical groove therein and a trigger body, the body being connected to the retainer, the trigger being defeatable on command.

18 Claims, 4 Drawing Sheets

ACTUATOR, METHOD AND SYSTEM

BACKGROUND

In the resource recovery and fluid sequestration industries, many tools require actuation. Actuating tools many hundreds or thousands of feet underground can be difficult. In some cases existing actuators are sufficient while in others, they are lacking. The art therefore always benefits from additional actuators added to the arsenal.

SUMMARY

An embodiment of an actuator including a housing, a biasing member within the housing, a retainer configured to retain the biasing member in a biased position, and a trigger holding the retainer, the trigger being defeatable on command.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
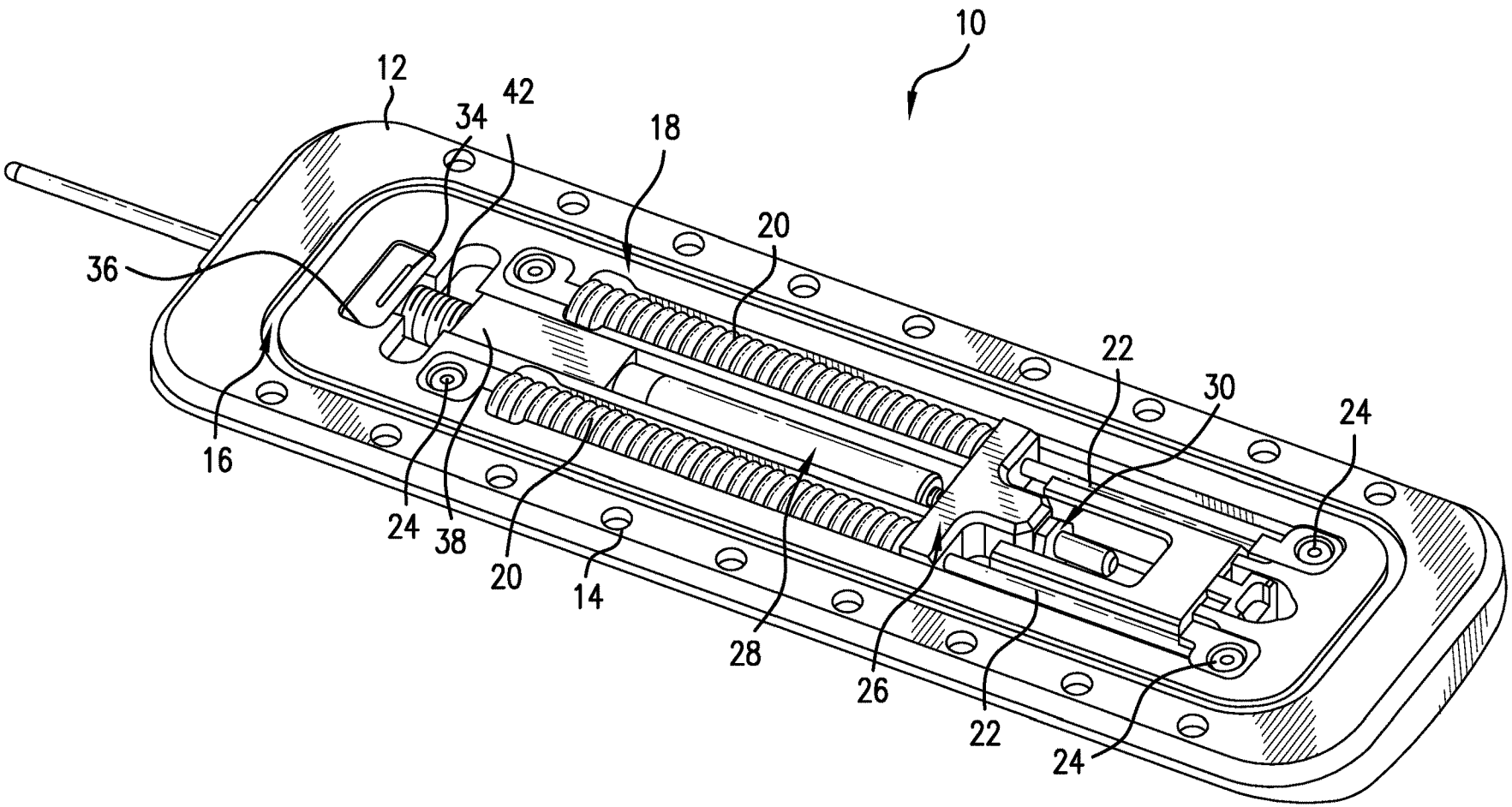
FIG. 1 is a perspective view of an actuator as disclosed herein in a run in condition.
Figure 2:
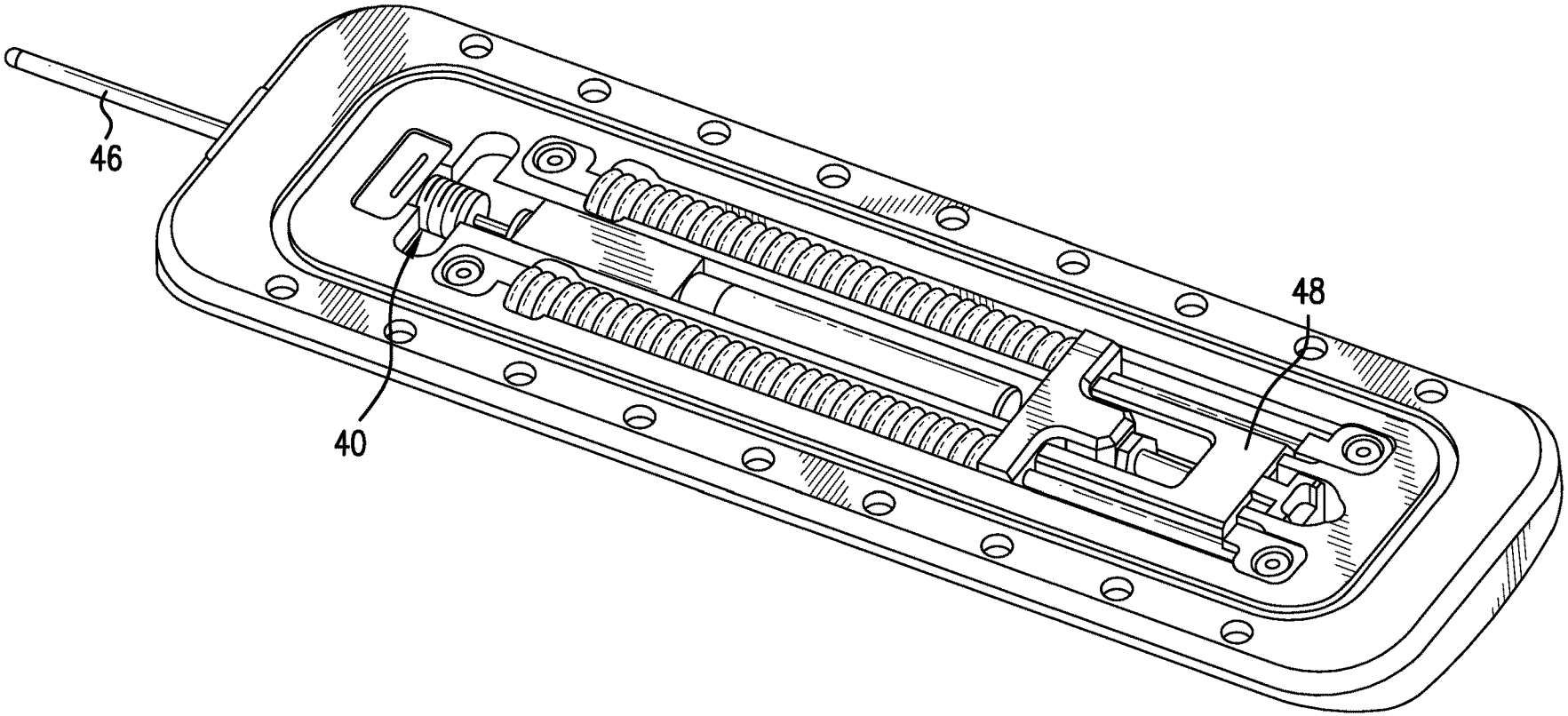
FIG. 2 is a perspective view of an actuator as disclosed herein in a triggered condition.
Figure 3:
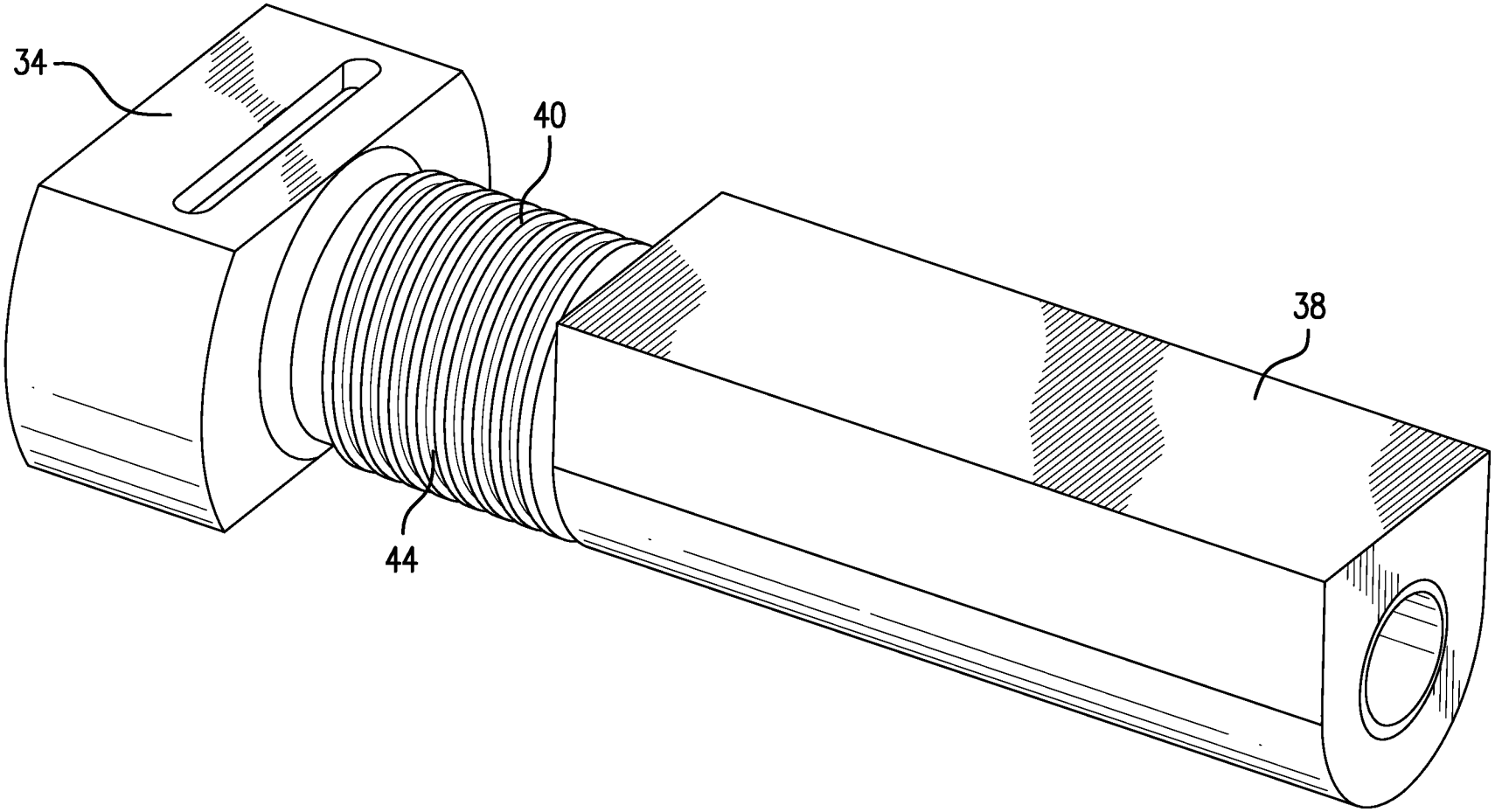
FIG. 3 is a perspective view of a trigger of the actuator.
Figure 4:
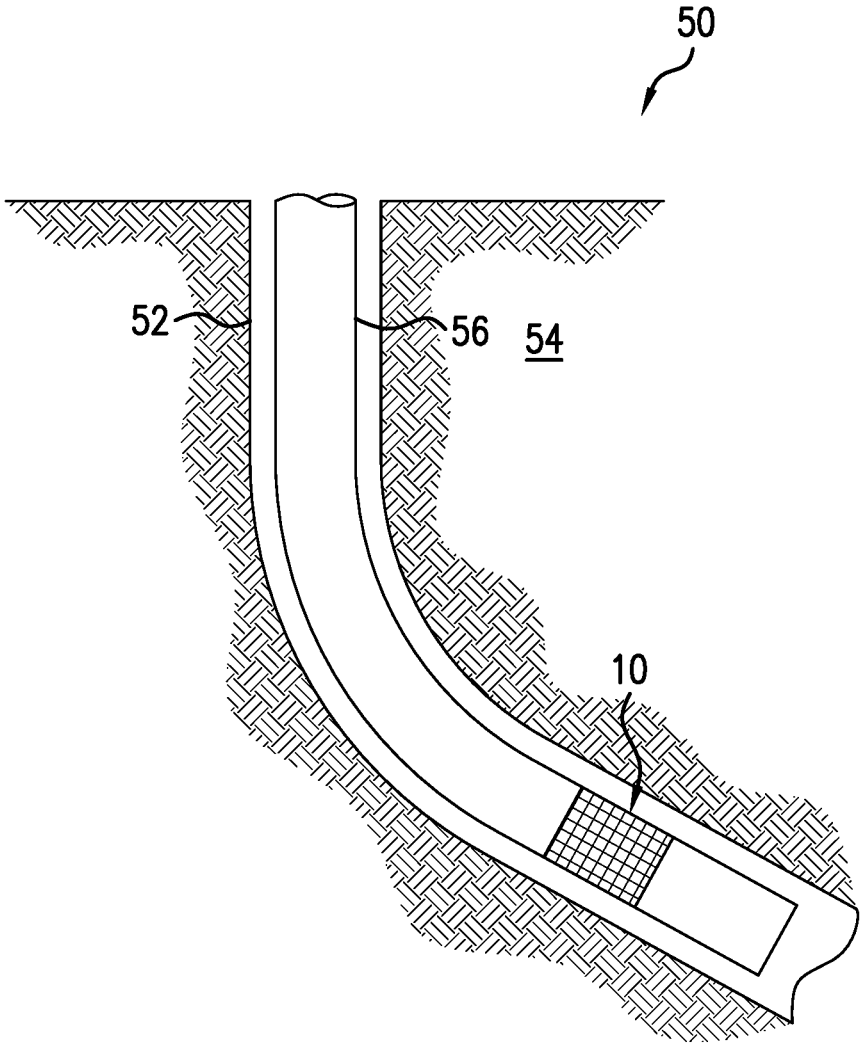
FIG. 4 is a schematic view of a wellbore system including the actuator disclosed herein.

Referring to FIG. 1, a perspective view of an actuator 10 as disclosed herein is illustrated. The actuator 10 may be built into a tool body (not shown) or may be modular as depicted. Actuator 10 includes a housing 12 (independent if Modular or could be a part of another tool). In the modular form, the housing includes a way to mount the actuator 10 to another tool such as by providing holes 14 for fasteners, for example. Also, for a modular embodiment, a seal recess 16 is provided in the housing to ensure the actuator is not contaminated with wellbore fluids and debris after being installed on a tool to be actuated and run downhole. Within the housing 12 is a biasing arrangement 18 that stores energy for use when the actuator 10 is triggered. In the illustrated embodiment, the arrangement 18 comprises a plurality of springs 20 but more or fewer are contemplated and coil springs as shown are not exclusive. Other biasing members such as gas chambers or resilient materials or configurations other than coil springs are also contemplated. In embodiments, the springs 20 may be disposed upon guides 22 that are fastened to the housing 12 by fasteners 24. A retainer 26 is positioned on the guides 22 and is slidable thereon relative to housing 12 such that a compressive load may be placed upon the biasing arrangement 18 through movement of the retainer 26 in the compression direction of the biasing arrangement 18. In the compressed position of biasing arrangement 18, the retainer, being attached to a trigger 28 at retaining nut 30 (or other fastener such as simply threads in the retainer 26) is held in this position until the trigger is released. The trigger 28 comprises a head 34 that is received in a recess 36 of housing 12. While in the recess 36, it will be readily appreciated that the trigger head 34 cannot move. Between the head 34 and a trigger body 38 is a separation neck 40 (best seen in FIG. 3). At the separation neck 40 is placed a heating element. In an embodiment, the heating element is in the form of a wire 42 that is wrapped around the separation neck in a helical groove 44. When the actuator 10 is in the ready position, the biasing arrangement is compressed putting the trigger 28 in tension between the head bearing against the housing 12 and the retainer 26. Activation of the heating element, which may be by flowing a current therein, will cause degradation of the material of the trigger in the area of the separation neck 40. Once the separation neck 40 is degraded enough to part, the actuator will release the energy stored in the biasing arrangement because with the separation neck 40 parted (seen in FIG. 2) there is no longer any structure in tension holding the biasing arrangement in compression and that compressed energy is available to actuate another tool.

In embodiments, the trigger 28 may comprise a PEEK-based polymer, or one with similar properties (such as tensile strength, glass transition temperature and melting temperature) or a metal having a low melting temperature, such as bismuth or solder. The selection of material requires that the material has sufficient tensile strength to retain the force generated by the compressed biasing arrangement 18 and also is responsive to the amount of heat generatable by the heating element. Obviously, the selection of material is affected by the choice of heating element used as greater or lesser degrees of heat are produced by different elements. One of ordinary skill in the art is capable of determining a material based upon its thermal degradation temperatures and the elements that have been selected.

In some embodiments, a piston 46 is also employed to transmit hydraulic pressure to the trigger 28. When the piston is used, the hydraulic pressure will add to the energy stored in the biasing arrangement thereby more easily causing the parting of the separation neck 40.

Also in embodiments, a bumper 48 may be used to absorb impact force from the biasing arrangement 18 after the actuator 10 has been triggered.

Further disclosed herein is a wellbore system 50. The wellbore system 50 includes a borehole 52 in a subsurface formation 54. A string 56 is disposed in the borehole 52 and an actuator 10 is disposed with the string 56.

Set forth below are some embodiments of the foregoing disclosure:

Embodiment 1: An actuator including a housing, a biasing member within the housing, a retainer configured to retain the biasing member in a biased position, and a trigger holding the retainer, the trigger being defeatable on command.

Embodiment 2: The actuator as in any prior embodiment, wherein the housing includes a surface configured to match a tubular in which the housing is to be installed.

Embodiment 3: The actuator as in any prior embodiment, wherein the housing includes a seal groove.

Embodiment 4: The actuator as in any prior embodiment, wherein the biasing member is a compression spring.

Embodiment 5: The actuator as in any prior embodiment, wherein the biasing member is a plurality of compression springs.

Embodiment 6: The actuator as in any prior embodiment, wherein the trigger is configured to engage the housing and the retainer such that the trigger is held in tension.

Embodiment 7: The actuator as in any prior embodiment, wherein the trigger includes a heating element disposed thereon.

Embodiment 8: The actuator as in any prior embodiment, wherein the heating element is a wire.

Embodiment 9: The actuator as in any prior embodiment, wherein the trigger is susceptible to degradation upon application of localized heat.

Embodiment 10: The actuator as in any prior embodiment, wherein the degradation is melting.

Embodiment 11: The actuator as in any prior embodiment, wherein the trigger, when degraded, releases the retainer thereby allowing the biasing member to extend.

Embodiment 12: The actuator as in any prior embodiment, wherein the trigger further includes a piston component exposed to hydrostatic pressure when the actuator is in use.

Embodiment 13: The actuator as in any prior embodiment, further including a bumper to absorb impact energy from the biasing member.

Embodiment 14: A method for causing an actuation of the actuator as in any prior embodiment, comprising applying an electric current to a heating element disposed about the trigger.

Embodiment 15: The method as in any prior embodiment, further comprising melting the trigger.

Embodiment 16: The actuator as in any prior embodiment, further comprising releasing stored energy in the biasing member.

Embodiment 17: A wellbore system including a borehole in a subsurface formation, a string in the borehole, and an actuator as in any prior embodiment, disposed with the string.

Embodiment 18: A system as in any prior embodiment, wherein the actuator is connected to actuate a downhole tool.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An actuator comprising:

a modular housing;

a biasing member within the housing;

a retainer configured to retain the biasing member in a biased position; and a trigger holding the retainer, the trigger having a trigger head anchorable to the housing, a separation neck having a helical groove therein and a trigger body, the body being connected to the retainer, the trigger being deflatable on command.

2. The actuator as claimed in claim 1 wherein the housing includes a surface configured to match a tubular in which the housing is to be installed.

3. The actuator as claimed in claim 1 wherein the housing includes a seal groove.

4. The actuator as claimed in claim 1 wherein the biasing member is a compression spring.

5. The actuator as claimed in claim 1 wherein the biasing member is a plurality of compression springs.

6. The actuator as claimed in claim 1 wherein the trigger is configured to engage the housing and the retainer such that the trigger is held in tension.

7. The actuator as claimed in claim 1 wherein the trigger includes a heating element disposed thereon.

8. The actuator as claimed in claim 7 wherein the heating element is a wire.

9. The actuator as claimed in claim 1 wherein the trigger is susceptible to degradation upon application of localized heat.

10. The actuator as claimed in claim 9 wherein the degradation is melting.

11. The actuator as claimed in claim 1 wherein the trigger, when degraded, releases the retainer thereby allowing the biasing member to extend.

12. The actuator as claimed in claim 1 wherein the trigger further includes a piston component exposed to hydrostatic pressure when the actuator is in use.

13. The actuator as claimed in claim 1 further including a bumper to absorb impact energy from the biasing member.

14. The actuator as claimed in claim 1 further comprising releasing stored energy in the biasing member.

15. A method for causing an actuation of the actuator as claimed in claim 1 comprising:

applying an electric current to a heating element disposed about the trigger.

16. The method as claimed in claim 15 further comprising melting the trigger.

17. A wellbore system comprising:

a borehole in a subsurface formation;

a string in the borehole; and an actuator as claimed in claim 1 disposed with the string.

18. The system as claimed in claim 17 wherein the actuator is connected to actuate a downhole tool.

* * * * *